US006569537B1

(12) United States Patent
Nomura et al.

(10) Patent No.: US 6,569,537 B1
(45) Date of Patent: May 27, 2003

(54) SURFACE TREATMENT METHOD SLIDING MEMBER AND PISTON

(75) Inventors: Masaya Nomura; Yoshinobu Ozaki, both of Hamamatsu (JP)

(73) Assignee: Suzuki Motor Corporation (JP)

( * ) Notice: Subject to any disclaimer, the term of this patent is extended or adjusted under 35 U.S.C. 154(b) by 0 days.

(21) Appl. No.: 09/553,525

(22) Filed: Apr. 20, 2000

(30) Foreign Application Priority Data

Apr. 28, 1999 (JP) ..... 11-120917

(51) Int. Cl.[7] ..... B32B 15/04
(52) U.S. Cl. ..... 428/469; 428/696
(58) Field of Search ..... 428/323, 469, 428/471, 472.2, 689, 696, 704; 148/273, 275, 279, 283

(56) References Cited

U.S. PATENT DOCUMENTS

| | | | | |
|---|---|---|---|---|
| 4,566,960 A | | 1/1986 | Mohr | 204/129.75 |
| 4,650,525 A | | 3/1987 | Yoshida et al. | 148/6.2 |
| 4,710,366 A | * | 12/1987 | Astley et al. | 423/158 |
| 5,125,989 A | | 6/1992 | Hallman | 148/247 |
| 5,584,946 A | | 12/1996 | Karmaschek et al. | 148/247 |
| 6,171,706 B1 | * | 1/2001 | Mihoya et al. | 148/275 |
| 6,303,232 B1 | * | 10/2001 | Mihoya et al. | 148/273 |

FOREIGN PATENT DOCUMENTS

| | | | |
|---|---|---|---|
| DE | 2445622 A1 | 4/1976 | C10M/3/02 |
| DE | 3512442 A1 | 10/1985 | C23C/22/34 |
| JP | 0020163386 AA | 6/1990 | C23C/22/34 |
| WO | WO 85/05131 | 11/1985 | C23F/7/00 |

* cited by examiner

*Primary Examiner*—Deborah Jones
*Assistant Examiner*—Enrique Osorio
(74) *Attorney, Agent, or Firm*—Myers Bigel Sibley & Sajovec, P.A.

(57) ABSTRACT

This invention relates to a surface treatment method comprising the steps of providing a treating solution containing a specific ammonium compound or aqueous ammonia, and magnesium silicofluoride, heating the treating solution to a temperature of 70 to 100° C., and soaking aluminum or an aluminum alloy in the treating solution; a piston having a surface coated with a film consisting of a mixture of $NH_4MgAlF_6$ and $MgAlF_5 \cdot 1.5H_2O$ or a mixture of $NH_4MgAlF_6$ and $MgAl_2F_8 \cdot 2H_2O$; and a sliding member made of aluminum or the like wherein the whole surface of the sliding member or the sliding surface thereof is coated with a film which consists of either of the aforesaid mixtures, has a cubic crystal structure, and shows no crystalline orientation. The present invention can provide a surface treatment method which requires simple equipment, can reduce treatment costs, and can yield aluminum or an aluminum alloy having excellent abrasion resistance, corrosion resistance and other properties, as well as sliding members and pistons having excellent abrasion resistance and other properties.

3 Claims, 12 Drawing Sheets

X4.500

X4.500

X400

X400

SURFACE TREATMENT METHOD SLIDING MEMBER AND PISTON

BACKGROUND OF THE INVENTION

1. Field of the Invention

This invention relates to a surface treatment method for aluminum or an aluminum alloy, and pistons surface-treated thereby, as well as a surface-treating film for aluminum or an aluminum alloy, and sliding members having a sliding surface coated therewith.

More particularly, this invention relates to a surface treatment method which requires simple equipment, can reduce treatment costs, and can yield aluminum or an aluminum alloy having excellent abrasion resistance, corrosion resistance and other properties, as well as pistons having undergone a surface treatment according to this method. It also relates to a surface-treating film suitable for use on the sliding surfaces of internal combustion engines and having excellent abrasion resistance, initial fitness, oil retention and other properties, and sliding members coated with such a slide film.

2. Description of the Related Art

The Alumite treatment which has conventionally been employed is a method for anodizing aluminum in an acid bath to form a hard aluminum oxide film on the aluminum surface. However, this method has the disadvantage that it requires equipment for electric power supply and that it involves a considerable cost because of a slow rate of film formation.

On the other hand, the skirt of an aluminum or aluminum alloy piston as an internal combustion engine component is plated with tin. Although the deposited tin film is effective in bring about good initial fitness, it cannot be expected to have the effect of improving abrasion resistance.

SUMMARY OF THE INVENTION

In view of the above-described problems of conventional surface treatment techniques, the present inventors made intensive investigations for the purpose of developing a surface treatment method which requires simple equipment, can reduce treatment costs, and can form a uniform film having excellent corrosion resistance, abrasion resistance and other properties, as well as sliding members surface-treated by such a method.

As a result, the present inventors have found that the above-described problems can be solved by a surface treatment method comprising the steps of providing a treating solution (or aqueous solution) containing magnesium silicofluoride ($MgSiF_6 \cdot 6H_2O$) and a specific ammonium compound or the like, heating this treating solution to a temperature in the range of 70 to 100° C., and soaking aluminum or an aluminum alloy in this treating solution.

Moreover, it has been found that the above-described problems can also be solved by coating the whole surface of a sliding member or the sliding surface thereof with a specific film consisting of a mixture of $NH_4MgAlF_6$ and $MgAlF_5 \cdot 1.5H_2O$ or a mixture of $NH_4MgAlF_6$ and $MgAl_2F_8 \cdot 2H_2O$.

Furthermore, it has been found that the above-described problems can also be solved, for example, by using a specific film formed on a surface of aluminum or an aluminum alloy, consisting of a mixture of $NH_4MgAlF_6$ and $MgAlF_5 \cdot 1.5H_2O$ or a mixture of $NH_4MgAlF_6$ and $MgAl_2F_8 \cdot 2H_2O$, and having silicon particles dispersed therein. The present invention has been completed from this point of view.

That is, according to a first aspect of the present invention, there is provided a surface treatment method comprising the steps of providing a treating solution containing an ammonium compound selected from ammonium borofluoride and ammonium chloride, or aqueous ammonia, and magnesium silicofluoride ($MgSiF_6 \cdot 6H_2O$); heating the treating solution to a temperature of 70 to 100° C.; and soaking aluminum or an aluminum alloy in the treating solution. In this surface treatment method, the aforesaid treating solution preferably contains 0.1 to 20 parts by weight of magnesium silicofluoride and 0.01 to 10 parts by weight, as expressed in terms of ammonium ($NH_4$), of the ammonium compound or aqueous ammonia. The ammonium compound used herein preferably comprises a compound which has a solubility of not less than 1 g/L in water and, when dissolved, can provide ammonium ions ($NH_4^+$) to the solution. Specifically, ammonium borofluoride ($NH_4BF_4$) or ammonium chloride ($NH_4Cl$) is used.

Moreover, the present invention also provides a piston having undergone a surface treatment according to the above-described surface treatment method.

According to a second aspect of the present invention, there is provided a piston wherein a surface thereof is coated with a film consisting of a mixture of $NH_4MgAlF_6$ and $MgAlF_5 \cdot 1.5H_2O$ or a mixture of $NH_4MgAlF_6$ and $MgAl_2F_8 \cdot 2H_2O$, and preferably its whole surface including the piston ring grooves, piston pin boss, skirt, piston head and internal piston surface is coated with the film. In this piston, the thickness of the film is preferably in the range of 1 to 20 $\mu$m.

According to a third aspect of the present invention, there is provided a sliding member made of a base metal comprising aluminum or an aluminum alloy, wherein the whole surface of the sliding member or the sliding surface thereof is coated with a film which consists of a mixture of $NH_4MgAlF_6$ and $MgAlF_5 \cdot 1.5H_2O$ or a mixture of $NH_4MgAlF_6$ and $MgAl_2F_8 \cdot 2H_2O$, has a cubic crystal structure, and shows no crystalline orientation.

Moreover, there is also provided a sliding member wherein the whole surface of the sliding member or the sliding surface thereof is coated with a film which has a thickness of 1 to 20 $\mu$m and consists of a plurality of aggregates having a size of 1 to 20 $\mu$m, each aggregate being formed of microcrystals having a size of 1 $\mu$m or less.

According to a fourth aspect of the present invention, there is provided a surface-treating film for aluminum alloys wherein the surface-treating film is a film formed on a surface of aluminum or an aluminum alloy, consisting of a mixture of $NH_4MgAlF_6$ and $MgAlF_5 \cdot 1.5H_2O$ or a mixture of $NH_4MgAlF_6$ and $MgAl_2F_8 \cdot 2H_2O$, and having silicon particles dispersed therein, the content of silicon particles dispersed in the film is in the range of 1 to 24% by weight and preferably 6 to 24% by weight, and the content of silicon in the aluminum alloy is in the range of 4 to 24% by weight and 7 to 24% by weight.

Figure 1:
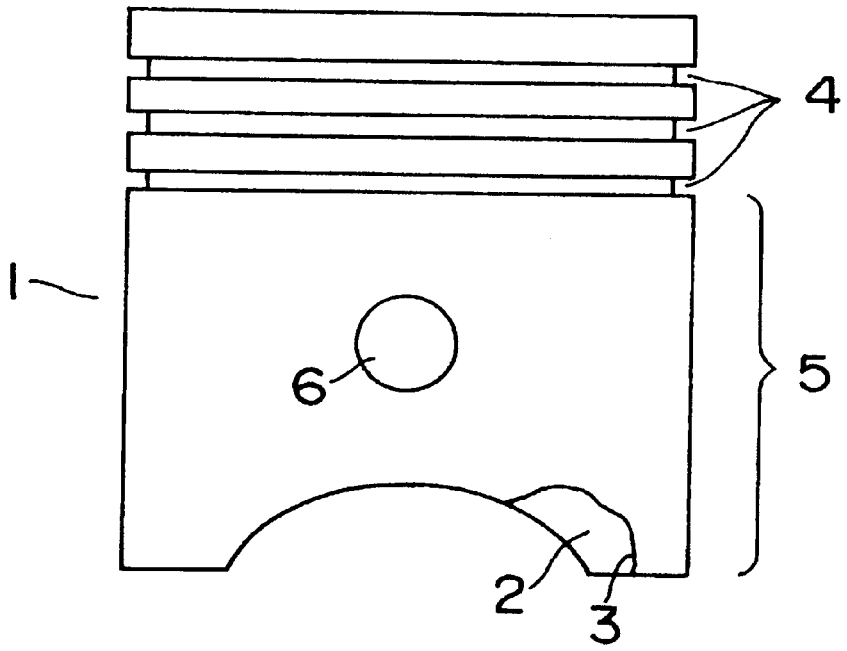
FIG. 1 is a schematic illustration of a piston in accordance with the present invention.

The reference numerals given in these views are defined as follows: 1, Piston; 2, Base metal; 3, Film; 4, Ring groove; 5, Skirt; 6, Pin hole; 7, Microcrystal; 8, Aggregate of microcrystals; 9, Silicon; 10, Aluminum alloy; 11, Film on aluminum surface.

DETAILED DESCRIPTION OF PREFERRED EMBODIMENTS

First, the surface treatment method in accordance with the first aspect of the present invention is described below.

The surface treatment method of the present invention comprises the steps of providing a treating solution (or aqueous solution) containing magnesium silicofluoride ($MgSiF_6 \cdot 6H_2O$) and a specific ammonium compound or aqueous ammonia, heating this treating solution to a temperature in the range of 70 to 100° C., and soaking aluminum or an aluminum alloy in this treating solution.

The ammonium compound used in the present invention preferably comprises a compound which has a solubility of not less than 1 g/L in water and, when dissolved, can provide ammonium ions ($NH_4^+$) to the solution. Specifically, such compounds include ammonium borofluoride and ammonium chloride. As the aqueous ammonia, there may be used aqueous ammonia having an ordinary concentration.

The treating solution used in the present invention preferably contains 0.1 to 20 parts by weight, more preferably 0.2 to 15 parts by weight, of magnesium silicofluoride ($MgSiF_6 \cdot 6H_2O$) and 0.01 to 10 parts by weight as expressed in terms of ammonium ($NH_4$), more preferably 0.02 to 5 parts by weight, of the aforesaid ammonium compound or the like, per 100 parts by weight of water. This treating solution makes it possible to form a film having better uniformity, abrasion resistance and corrosion resistance on the surface of the aluminum or aluminum alloy.

If the amount of magnesium silicofluoride ($MgSiF_6 \cdot 6H_2O$) is less than 0.1 part by weight or the amount, as expressed in terms of ammonium ($NH_4$), of the ammonium compound or the like is less than 0.01 part by weight in the treating solution used in the present invention, the reaction will be retarded to extend the treating time to an undue extent.

On the other hand, if the amount of magnesium silicofluoride ($MgSiF_6 \cdot 6H_2O$) is greater than 20 parts by weight or the amount, as expressed in terms of ammonium ($NH_4$), of the ammonium compound or the like is greater than 10 parts by weight, it may be difficult to dissolve the compound.

The material to be surface-treated according to the present invention is aluminum or an aluminum alloy. Specific examples thereof include pure aluminum, flattened aluminum materials, cast aluminum materials and die-cast aluminum materials. The present invention is applicable to any of the foregoing materials and has the effect of improving abrasion resistance, corrosion resistance and other properties as a result of the surface treatment.

The pretreatment of a material to be surface-treated may be carried out simply by removing contaminants (e.g., oil) attached thereto. However, its surface treatment may be carried out after the material is subjected to alkali etching with sodium hydroxide or the like, and acid cleaning.

According to the present invention, the aluminum or aluminum alloy to be surface-treated is soaked in the aforesaid treating solution (or aqueous solution).

The temperature of the treating solution in which the aluminum or aluminum alloy is soaked is usually in the range of 70 to 100° C., preferably 75 to 99° C., and more preferably 80 to 98° C. If the temperature of the treating solution is lower than 70° C., the reaction will be retarded to extend the treating time to an undue extent. On the other hand, if the temperature of the treating solution is higher than 100° C., the evaporation of the treating solution will be increased to an undue extent.

As to the treating time, it is sufficient for surface-treating purposes to soak the material in the treating solution for a period of about 2 minutes, because the film-forming reaction is completed in a period of about 1 minute. It is to be understood that, once a film is formed, the material may be soaked in the treating solution for 30 minutes or more without any problem, because this film has a protective effect.

The surface-treating film formed on aluminum or the like according to the above-described surface treatment method of the present invention has a protective effect and can hence improve the corrosion resistance of the aluminum base material. Moreover, the surface-treating film so formed has excellent abrasion resistance.

On the other hand, since the surface treatment method of the present invention requires no equipment for electric power supply, the equipment can be simplified and this is very advantageous from the viewpoint of cost. Moreover, as compared with conventional surface treatment techniques, the surface treatment method of the present invention gives a faster rate of film formation on the surface of aluminum or the like, and hence has higher productivity.

Next, the piston in accordance with the second aspect of the present invention is described below.

The piston of the present invention is a piston having undergone a surface treatment according to a surface treatment method which comprises the steps of providing a treating solution (or aqueous solution) containing magnesium silicofluoride ($MgSiF_6 \cdot 6H_2O$) and the aforesaid specific ammonium compound, heating this treating solution to a temperature in the range of 70 to 100° C., and soaking aluminum or an aluminum alloy in this treating solution. In this method, it is preferable that the aforesaid treating solution contain 0.1 to 20 parts by weight of magnesium silicofluoride ($MgSiF_6 \cdot 6H_2O$) and 0.01 to 10 parts by weight, as expressed in terms of ammonium ($NH_4$), of the aforesaid ammonium compound, per 100 parts by weight of water.

Before forming a film according to the above-described surface treatment method, the piston of the present invention is cleaned with an organic solvent, a degreasing agent and the like. The present invention may be applied to a wide variety of common engine pistons made of aluminum alloy.

The cleaned engine piston is soaked in the treating solution according to the above-described surface treatment method. Thus, a film consisting of a mixture of $NH_4MgAlF_6$ and $MgAlF_5 1.5H_2O$ or a mixture of $NH_4MgAlF_6$ and $MgAl_2F_8 \cdot 2H_2O$ is formed on the piston surface. In this treatment, a mixture of $NH_4MgAlF_6$ and $MgAlF_6 \cdot 1.5H_2O$ or a mixture of $NH_4MgAlF_6$ and $MgAl_2F_8 \cdot 2H_2O$ is deposited in such a way that, when the amount of ammonium (NH4) supplied is insufficient to form a film consisting of $NH_4MgAlF_6$ alone, $MgAlF_5 \cdot 1.5H_2O$ or $MgAl_2F_8 \cdot 2H_2O$ crystallized out in admixture with $NH_4MgAlF_6$. During this process, a film consisting of $NH_4MgAlF_6$ alone may be partly formed. Either of the aforesaid films has excellent abrasion resistance.

As to the treating time, it is sufficient for surface-treating purposes to soak the piston in the treating solution for a period of about 2 minutes and preferably 2 to 10 minutes, because the film-forming reaction is completed in a period of about 1 minute similarly to the above-described surface treatment method. It is to be understood that, once a film is formed, the piston may be soaked in the treating solution for 30 minutes or more without any problem, because this film has a protective effect.

In the piston of the present invention which is obtained in the above-described manner, its surface is coated with a film consisting of a mixture of $NH_4MgAlF_6$ and $MgAlF_5 1.5H_2O$ or a mixture of $NH_4MgAlF_6$ and $MgAl_2F_8 \cdot 2H_2O$, and optionally including a film consisting of $NH_4MgAlF_6$ alone, and hence exhibits excellent surface properties. This film can produce a beneficial effect even if it is formed on any of various parts such as the piston ring grooves, piston pin boss, skirt, piston head and all side faces. However, it is preferable that its whole surface including these parts be coated with the film.

The above-described piston of the present invention is not so soft as conventional pistons plated, for example, with tin, but has excellent abrasion resistance and very good durability.

Next, the sliding member in accordance with the third aspect of the present invention is described below.

The sliding member of the present invention is made of a base metal comprising aluminum or an aluminum alloy, and the whole surface of the sliding member or the sliding surface thereof is coated with a film which consists of a mixture of $NH_4MgAlF_6$ and $MgAlF_5 \cdot 1.5H_2O$ or a mixture of $NH_4MgAlF_6$ and $MgAl_2F_8 \cdot 2H_2O$, has a cubic crystal structure, and shows no crystalline orientation. Either of the aforesaid films has excellent abrasion resistance, and may include a film consisting of $NH_4MgAlF_6$ alone.

Moreover, the sliding member of the present invention is such that the whole surface of the sliding member or the sliding surface thereof is coated with a film which has a thickness of 1 to 20 $\mu$m and consists of a plurality of aggregates having a size of 1 to 20 $\mu$m, each aggregate being formed of microcrystals having a size of 1 $\mu$m or less.

This sliding member is more specifically described below with reference to FIG. 1.

Referring to FIG. 1, a piston 1 for use in an internal combustion engine, which is a sliding member, is made of a base metal 2 comprising an aluminum alloy. The surface of the base metal is coated with a film 3 for improving its sliding characteristics. Its skirt 5 slides over the inner wall of a cylinder bore constituting the opposite member, its ring grooves 4 slide against piston rings, and its pin hole 6 slides over a piston pin.

By way of example, an Al—Si—Cu—Ni—Mg alloy or the like is used as base metal 2. Specific examples of the alloy include AC8A, AC8B, AC9A and AC9B.

Film 3 is formed on the surface of piston 1 by subjecting piston 1 to a chemical conversion treatment. This film 3 may comprise a film consisting of a mixture of $NH_4MgAlF_6$ and $MgAlF_5 \cdot 1.5H_2O$ or a mixture of $NH_4MgAlF_6$ and $MgAl_2F_8 \cdot 2H_2O$. Optionally, this film 3 may include a film consisting of $NH_4MgAlF_6$ alone. Even though film 3 has any of these compositions, it has a cubic crystal structure and shows no crystalline orientation.

Figure 2:
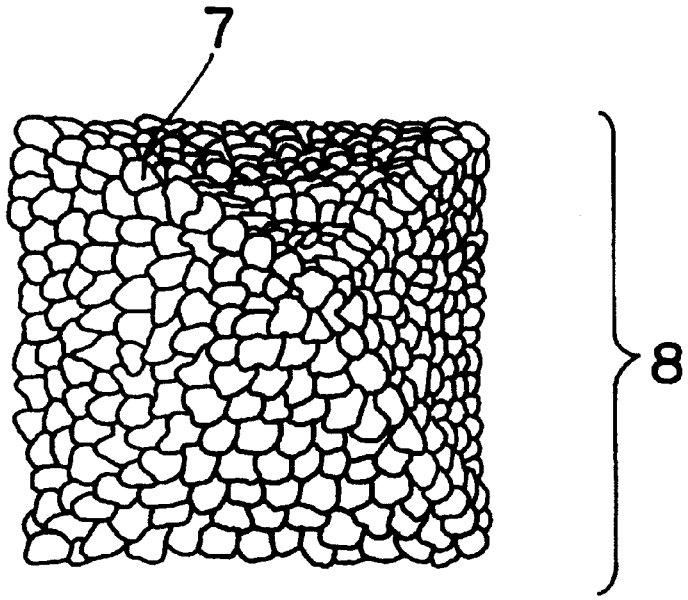
FIG. 2 is a schematic view of a surface-treating film in accordance with the present invention.
Figure 3:
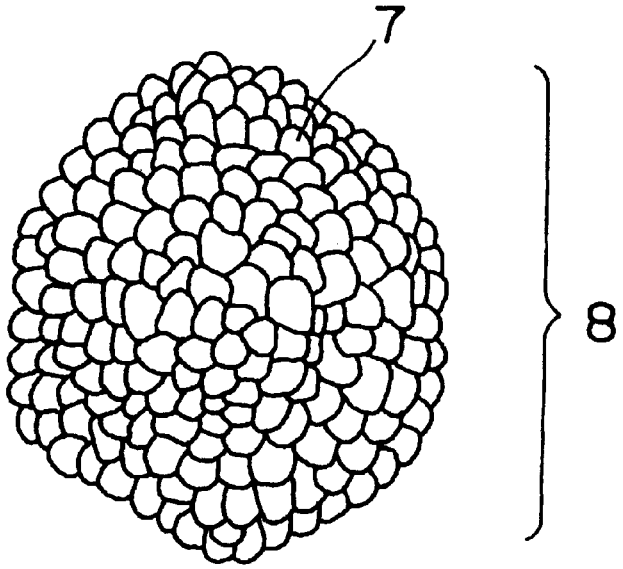
FIG. 3 is a schematic view of a surface-treating film in accordance with the present invention.

This film 3 consists of microcrystals 7 having a size of 1 $\mu$m or less. These microcrystals 7 gather together to form a plurality of aggregates 8 having a size of 1 to 20 $\mu$m, and these aggregates 8 coat the surface of the base metal to a thickness of 1 to 20 $\mu$m (FIGS. 2 and 3). This film forms a new sliding surface. The configuration of these aggregates 8 varies according to the amount of $MgAlF_5 \cdot 1.5H_2O$ or $MgAl_2F_8 \cdot 2H_2O$ mixed with $NH_4MgAlF_6$.

These microcrystals 7 and aggregates 8 constituting film 3 causes an increase in the surface area of the sliding surface and hence an improvement in oil retention. Moreover, since aggregates 8 are preferentially worn away, the sliding surface exhibits good initial fitness. These improvements in wearing characteristics are effective in enhancing the durability of the sliding member, reducing friction, and improving fuel consumption.

Finally, the surface-treating film in accordance with the fourth aspect of the present invention is described below.

The surface-treating film for aluminum alloys in accordance with the present invention is a film formed on a surface of aluminum or an aluminum alloy, consisting of a mixture of $NH_4MgAlF_6$ and $MgAlF_5 \cdot 1.5H_2O$ or a mixture of $NH_4MgAlF_6$ and $MgAl_2F_8 \cdot 2H_2O$, and having silicon particles dispersed therein. Optionally, this film may include a film consisting of $NH_4MgAlF_6$ alone. Moreover, the content of silicon particles dispersed in the film is in the range of 1 to 24% by weight and preferably 6 to 24% by weight, and the content of silicon in the aforesaid aluminum alloy is in the range of 4 to 24% by weight and preferably 7 to 24% by weight.

Figure 4:
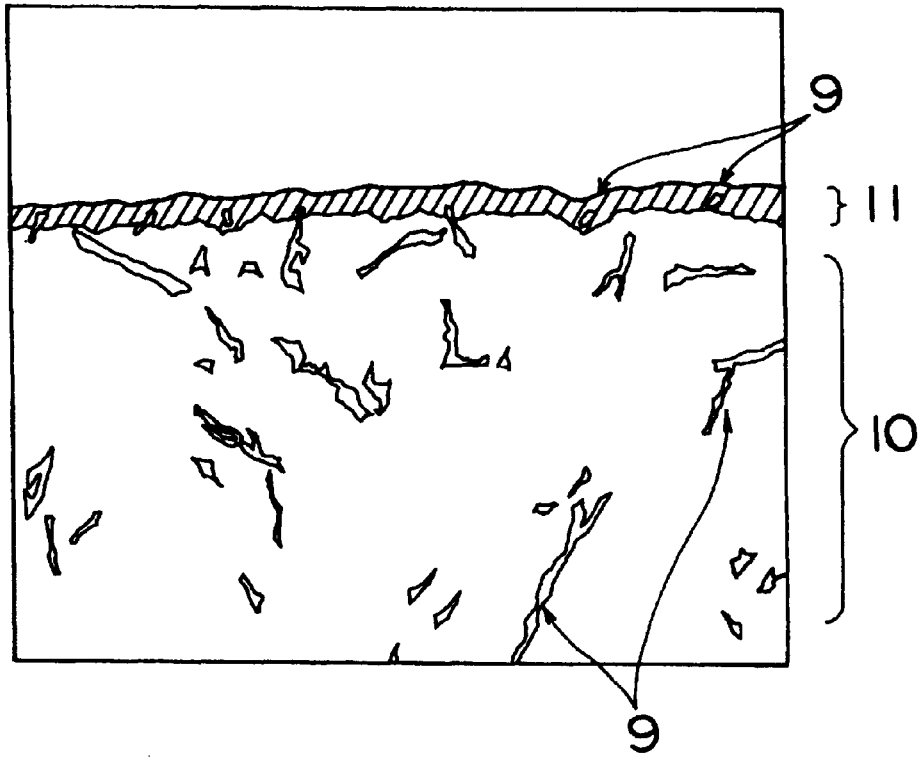
FIG. 4 is a schematic view of a cross section of a film.

The film structure obtained according to the present invention is shown in FIG. 4. The aluminum alloy constituting the base metal contains 4 to 24% by weight of silicon 9, and eutectic silicon or proeutectic silicon is dispersed in the aluminum matrix 10. The surface of the aluminum alloy is coated with a film consisting of a mixture of $NH_4MgAlF_6$ and $MgAlF_5 \cdot 1.5H_2O$ or a mixture of $NH_4MgAlF_6$ and $MgAl_2F_8 \cdot 2H_2O$, and silicon particles similar to the eutectic silicon or proeutectic silicon dispersed in the aluminum alloy base metal are dispersed in this film.

The above-described structure of the surface-treating film in accordance with the present invention can be obtained in the following manner.

An aluminum alloy material containing 4 to 24% by weight of silicon (Si) is degreased with an organic acid, a degreasing agent or the like, and then subjected to alkali etching with sodium hydroxide or the like, and acid cleaning. Subsequently, a treating solution (or aqueous solution) containing magnesium silicofluoride ($MgSiF_6 \cdot 6H_2O$) and an ammonium compound is heated to a temperature in the range of 70 to 100° C., and the aluminum alloy material is soaked therein for a period of about 2 to 10 minutes.

According to the above-described procedure, aluminum present in the surface of the aluminum alloy material is preferentially dissolved in the treating solution. At the same time, the dissolved aluminum (Al) reacts with fluorine (F), magnesium (mg) and ammonium ($NH_4$) present in the solution to form a film consisting of a mixture of $NH_4MgAlF_6$ and $MgAlF_5 \cdot 1.5H_2O$ or a mixture of $NH_4MgAlF_6$ and $MgAl_2F_8 \cdot 2H_2O$. This film deposits on the aluminum alloy surface while incorporating silicon particles which are hard to dissolve in the treating solution. Thus, there is obtained a film having silicon dispersed therein.

However, it is to be understood that, in the above-described procedure, degreasing with an organic solvent, degreasing agent or the like, alkali etching and acid cleaning serve to clean the base material and are not directly required to obtain the film structure of the present invention.

The present invention is more specifically explained with reference to the following examples. However, these examples are not to be construed to limit the scope of the present invention.

The surface treatment method for aluminum or an aluminum alloy in accordance with the present invention requires simple equipment, can reduce treatment costs, and can yield a film having excellent abrasion resistance, corrosion resistance and other properties.

That is, according to the present invention, the equipment can be simplified because the treating conditions are easy, and the resulting surface-coated aluminum or the like has excellent abrasion resistance and can reduce friction losses. Moreover, the film obtained by the method of the present invention has protective properties, so that it has a uniform film thickness over the whole surface of aluminum or the like without regard to the treating conditions, and shows little inequality in film thickness. Furthermore, the film thus obtained has excellent corrosion resistance and hence exhibits abrasion resistance even in a corrosive environment.

Moreover, the pistons having undergone a surface treatment according to the method of the present invention have excellent abrasion resistance, corrosion resistance and other properties. Accordingly, they have excellent durability and can be effectively used as pistons for various engines.

Furthermore, the durability of sliding members of engines, compressors and the like can be improved by coating the sliding surfaces of the sliding members made of aluminum or an aluminum alloy according to the present invention. For example, if engine pistons are coated, improvements in abrasion resistance, initial fitness, oil retention and other properties can be achieved. This is effective in enhancing durability, reducing friction, improving engine output, and improving fuel consumption, and hence has a very important significance from an industrial point of view.

EXAMPLE 1

This is an example in which an aluminum alloy was surface-treated with treating solutions (or aqueous solutions) containing magnesium silicofluoride ($MgSiF_6 \cdot 6H_2O$) and ammonium silicofluoride [$(NH_4)_2SiF_6$].

0.67 part by weight of magnesium silicofluoride ($MgSiF_6 \cdot 6H_2O$) and 0.13 part by weight of ammonium silicofluoride [$(NH_4)_2SiF_6$] were dissolved in 100 parts by weight of water. This aqueous solution was heated to 90° C. and used as treating solution 1. An AC8A-T6 cast aluminum specimen having a diameter of 50 mm and a thickness of 5 mm was cleaned with an organic solvent and a degreasing agent, and then surface-treated by soaking it in this treating solution 1 for 5 minutes.

Next, 0.67 part by weight of magnesium silicofluoride ($MgSiF_6 \cdot 6H_2O$) and 0.33 part by weight of ammonium silicofluoride [$(NH_4)_2SiF_6$] were dissolved in 100 parts by weight of water. This aqueous solution was heated to 90° C. and used as treating solution 2. An AC8A-T6 cast aluminum specimen having a diameter of 50 mm and a thickness of 5 mm was cleaned with an organic solvent and a degreasing agent, and then surface-treated by soaking it in this treating solution 2 for 5 minutes.

Figure 5:
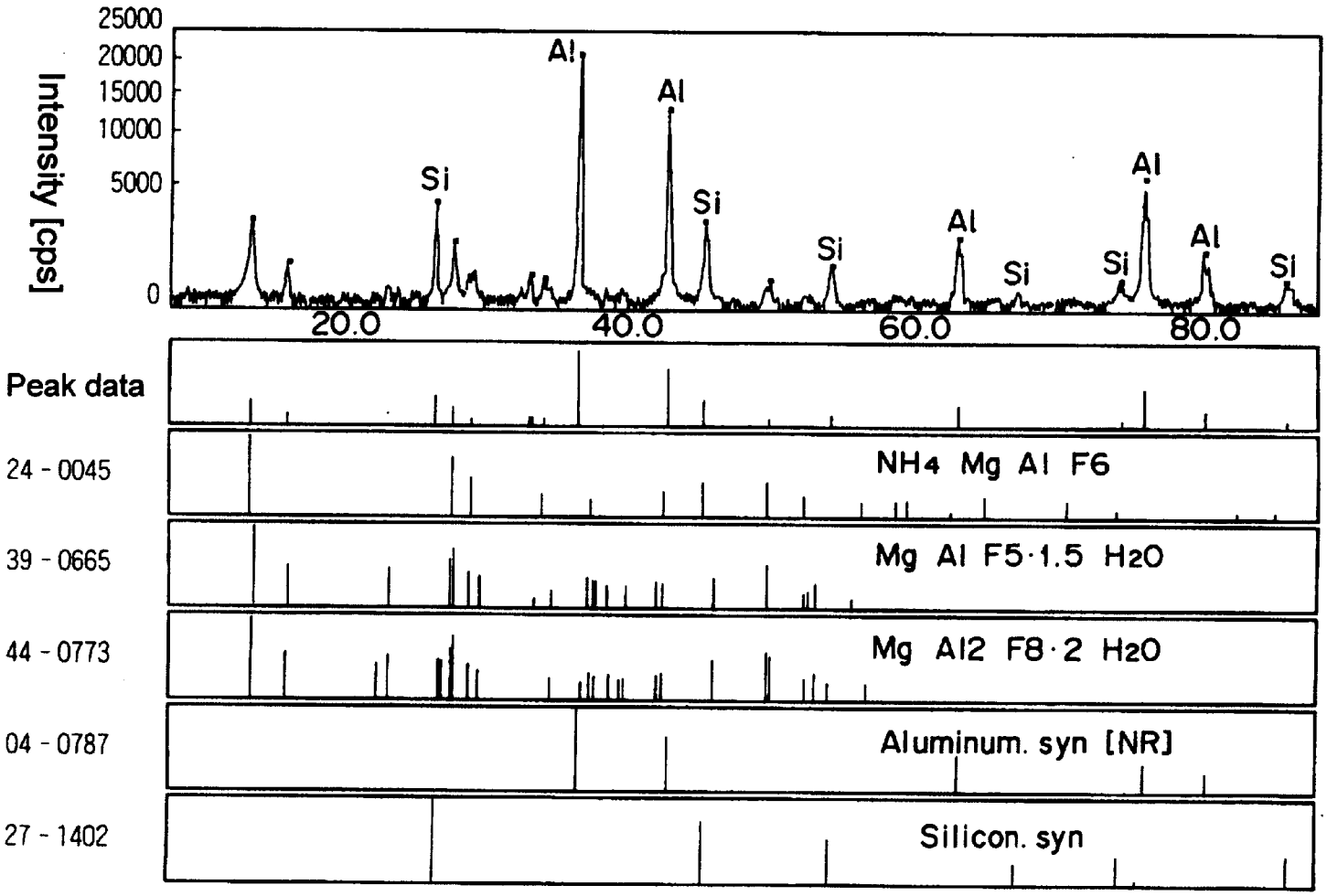
FIG. 5 is an X-ray diffraction diagram of a film formed with treating solution 1 of Example 1.

FIG. 5 shows the results of analysis of the formed film with an X-ray diffractometer, for the specimen having been surface-treated with the aforesaid treating solution 1.

It can be seen from FIG. 5 that a film consisting of a mixture of $NH_4MgAlF_6$ and $MgAlF_5 \cdot 1.5H_2O$ or a mixture of $NH_4MgAlF_6$ and $MgAl_2F_8 \cdot 2H_2O$ was formed on the surface of the cast aluminum specimen as a result of the treatment with treating solution 1. However, this X-ray diffraction diagram includes both the X-ray diffraction spectrum of the formed film and the X-ray diffraction spectra of aluminum (Al) constituting the base metal (i.e., AC8A-T6 material) and silicon (Si) contained in the base metal. It can also be seen from this k-ray diffraction diagram that the formed film showed no crystalline orientation.

Figure 6:
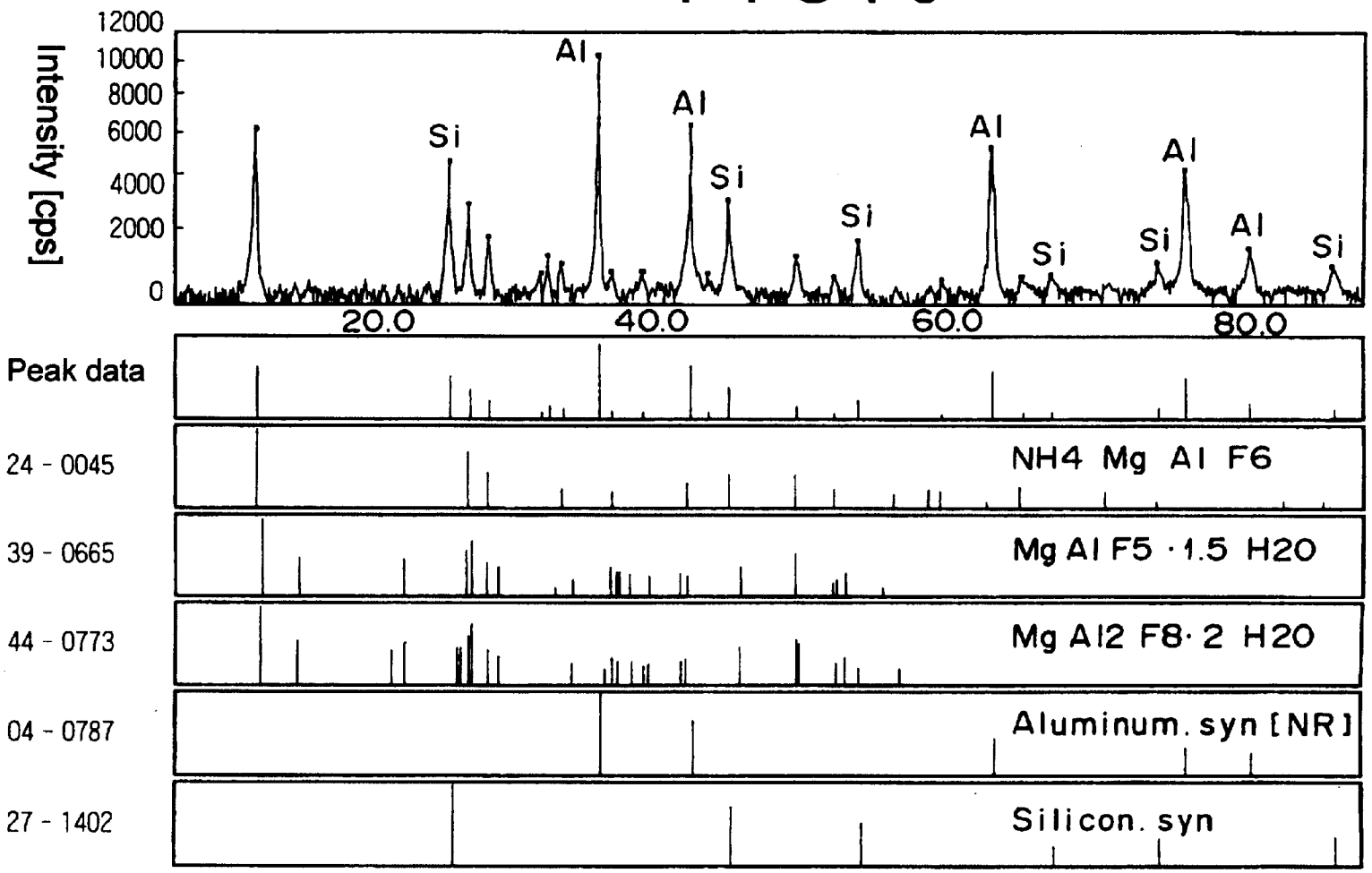
FIG. 6 is an X-ray diffraction diagram of a film formed with treating solution 2 of Example 1.

FIG. 6 shows the results of analysis of the formed film with an X-ray diffractometer, for the specimen having been surface-treated with the aforesaid treating solution 2.

It can be seen from FIG. 6 that a film of $NH_4MgAlF_6$ was formed on the surface of the cast aluminum specimen as a result of the treatment with treating solution 2. However, this X-ray diffraction diagram includes both the X-ray diffraction spectrum of the formed film and the X-ray diffraction spectra of aluminum (Al) constituting the base metal (i.e., AC8A-T6 material) and silicon (Si) contained in the base metal. It can also be seen from this X-ray diffraction diagram that the formed film showed no crystalline orientation.

With respect to the specimens having undergone the surface treatment of the present invention using the aforesaid treating solution 1 or 2, ball-on-disk abrasion tests were performed by using heat-treated SCM435 material as the opposite material. Moreover, a specimen (of AC8A-T6 material) having undergone no surface treatment was also subjected to a ball-on-disk abrasion test in the same manner.

Figure 7:
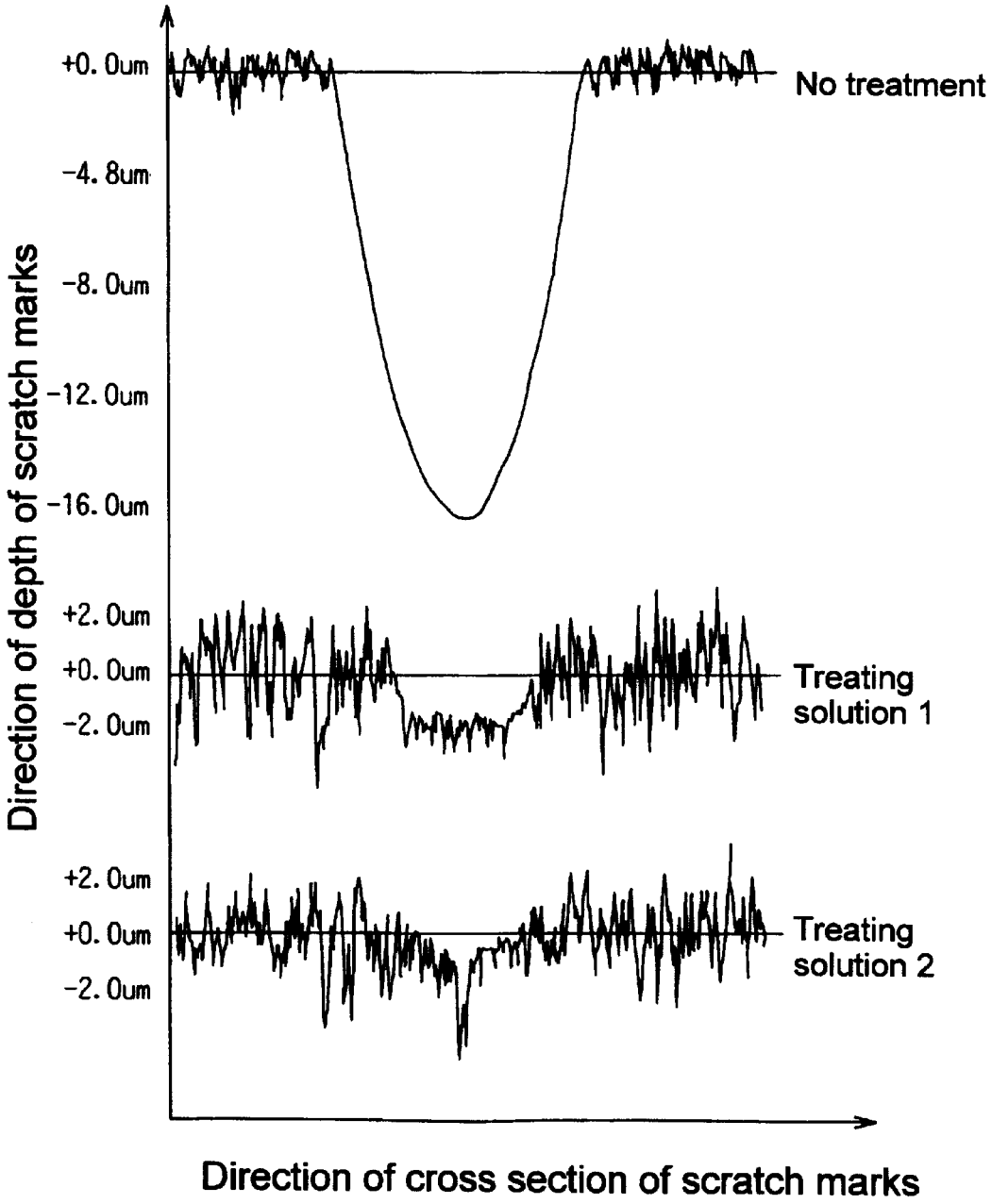
FIG. 7 is a diagram showing the cross-sectional shapes of scratch marks as observed in abrasion tests.

The cross-sectional shapes (or profiles) of the scratch marks so produced is shown in FIG. 7.

Figure 8:
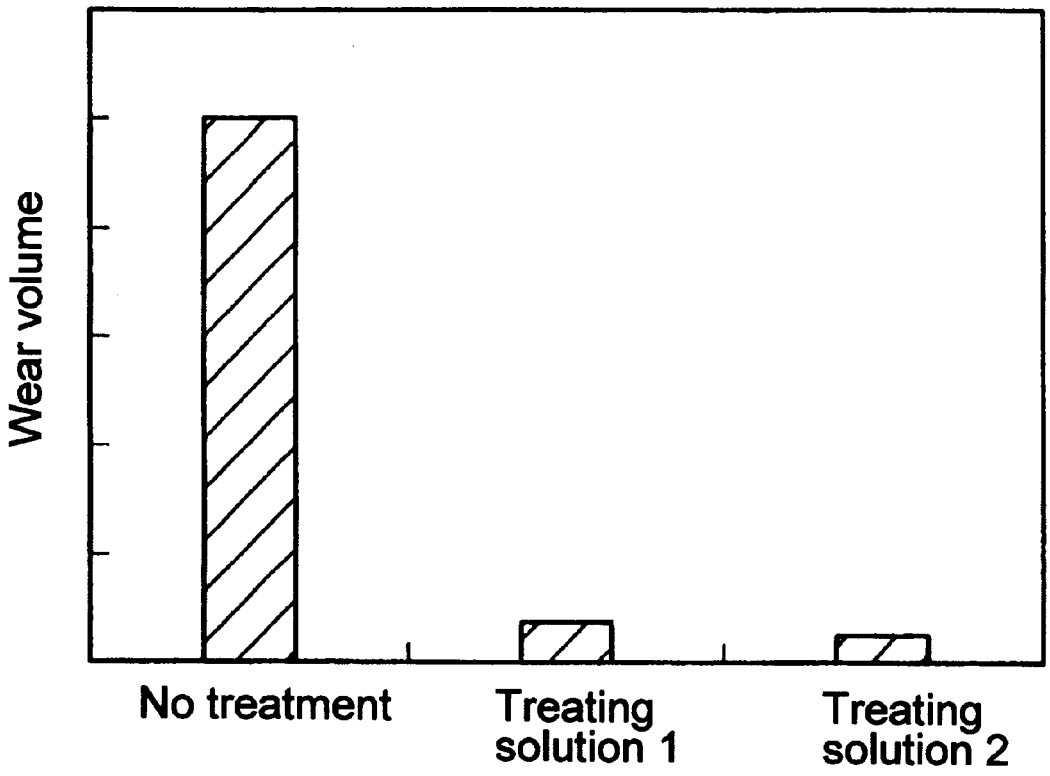
FIG. 8 is a graph showing wear volumes as observed in abrasion tests.

The wear volumes obtained from the results of the ball-on-disk abrasion tests are shown in FIG. 8.

It can be seen from FIG. 7 that, when compared with the specimen having undergone no surface treatment, the specimens having undergone the surface treatment of the present invention using the aforesaid treating solution 1 or 2 had excellent abrasion resistance.

It can be seen from FIG. 8 that the specimens having undergone the surface treatment of the present invention using the aforesaid treating solution 1 or 2 showed a wear volume equal to about 1/20 of that of the specimen having undergone no surface treatment, and hence had excellent abrasion resistance.

Moreover, it can be seen that, whether the film formed as a result of the surface treatment consisted of $NH_4MgAlF_6$ alone, a mixture of $NH_4MgAlF_6$ and $MgAlF_5 \cdot 1.5H_2O$, or a mixture of $NH_4MgAlF_6$ and $MgAl_2F_8 \cdot 2H_2O$, the specimens having undergone the surface treatment showed a marked improvement in abrasion resistance as compared with the specimen having undergone no surface treatment.

Figure 9:
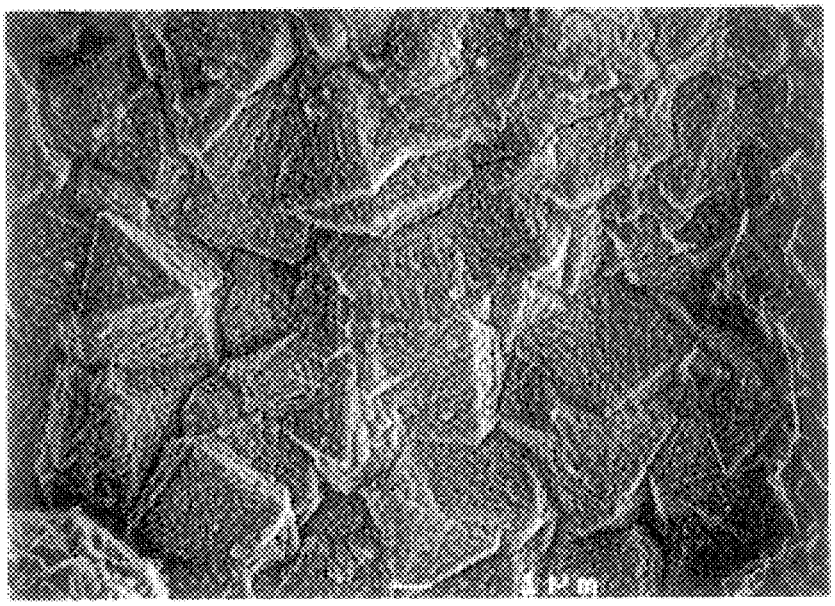
FIG. 9 is an electron micrograph of a film formed with treating solution 1 of Example 1.

FIG. 9 is an electron micrograph of the formed film, for the specimen having undergone the surface treatment using the aforesaid treating solution 1. FIG. 2 is a schematic view corresponding to FIG. 9.

It can be seen from FIGS. 2 and 9 that the film consists of microcrystals 7 having a size of 1 $\mu$m or less and these microcrystals gather together to form a plurality of aggregates 8 having a size of 1 to 20 $\mu$m. Moreover, it can be seen that the plurality of aggregates 8 covers the surface of the base metal (i.e., AC8A-T6 material) to form a film.

Figure 10:
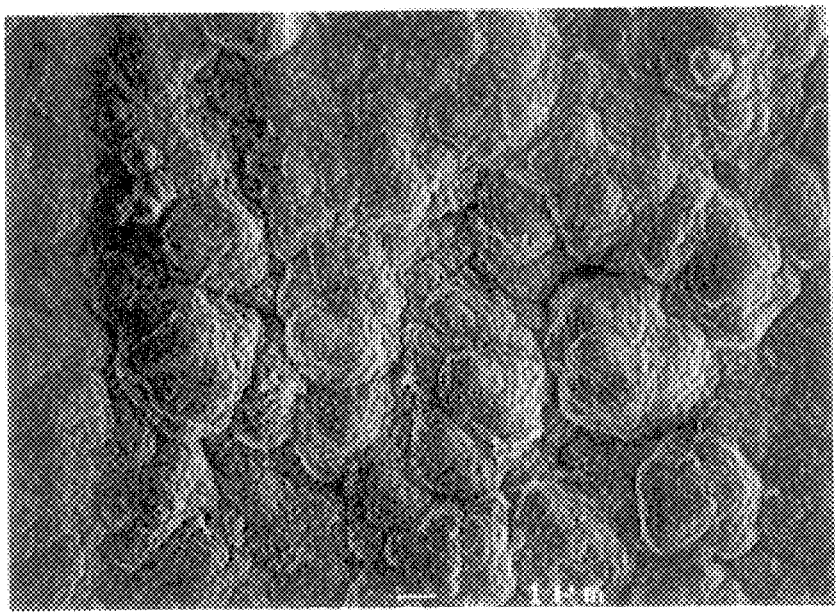
FIG. 10 is an electron micrograph of a film formed with treating solution 2 of Example 1.

FIG. 10 is an electron micrograph of the formed film, for the specimen having undergone the surface treatment using the aforesaid treating solution 2. FIG. 3 is a schematic view corresponding to FIG. 10.

It can be seen from FIGS. 3 and 10 that the film consists of microcrystals 7 having a size of 1 $\mu$m or less and these microcrystals gather together to form a plurality of aggregates 8 having a size of 1 to 20 $\mu$m. Moreover, it can be seen that the plurality of aggregates 8 covers the surface of the base metal (i.e., AC8A-T6 material) to form a film.

It can also be seen from FIGS. 9 and 10 that the configuration of aggregates 8 varies according to the composition of the film, i.e., the amount of $MgAlF_5 \cdot 1.5H_2O$ or $MgAl_2F_8 \cdot 2H_2O$ mixed with $NH_4MgAlF_6$ (see FIGS. 2 and 3).

Figure 11:
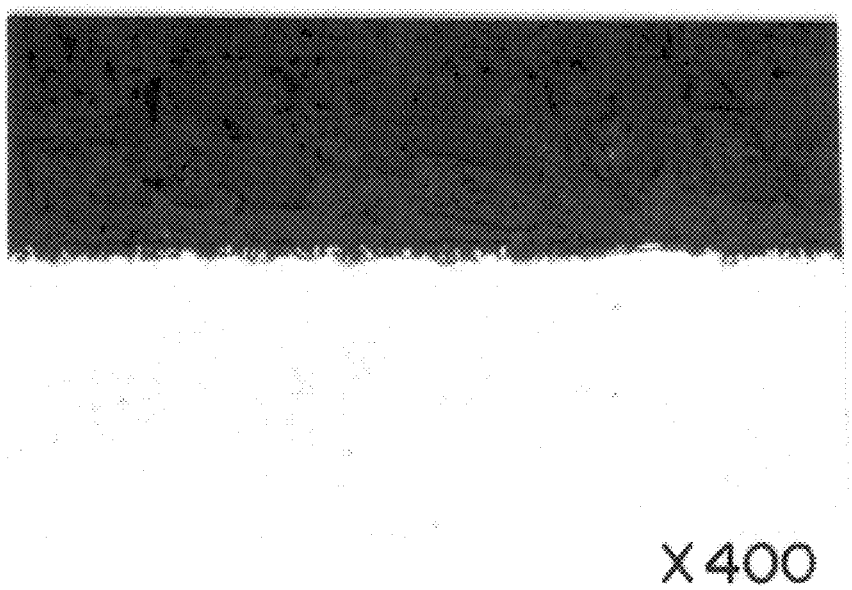
FIG. 11 is a photomicrograph of a cross section of a film formed with treating solution 1 of Example 1.
Figure 12:
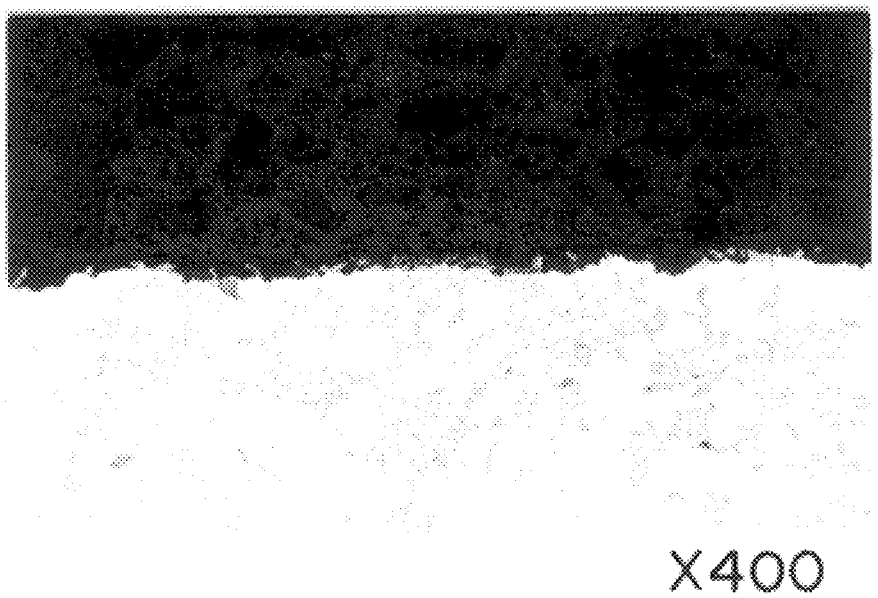
FIG. 12 is a photomicrograph of a cross section of a film formed with treating solution 2 of Example 1.

FIGS. 11 and 12 are photomicrographs of a cross section of the formed film, for the specimens having undergone the surface treatment using the aforesaid treating solution 1 or 2. FIG. 4 is a schematic view corresponding to FIGS. 11 and 12.

It can be seen from FIGS. 4, 11 and 12 that a film having a thickness of about 6 $\mu$m was formed on the surface of the base metal (i.e., AC8A-T6 material). Moreover, it can be seen that silicon (Si) particles derived from the base metal (i.e., AC8A material) are incorporated in the films shown in these photomicrographs. This is due to the fact that silicon particles contained in the base metal (i.e., AC8A-T6 material) remained on the surface of the base metal and were incorporated into the film formed during the surface treatment process.

EXAMPLE 2

An AC8A-T6 cast aluminum specimen having a diameter of 50 mm and a thickness of 5 mm was cleaned with an organic solvent and a degreasing agent, and then surface-treated by soaking it in a treating solution similar to treating solution 2 of the above Example 1 for 5 minutes.

With respect to the specimen having undergone the above-described surface treatment (i.e., the specimen of Example 2) and a specimen not having undergone the above-described surface treatment (i.e., an untreated specimen), their corrosion resistance was evaluated by salt water spray tests.

It can be seen from the results thus obtained that the specimen of the present invention showed a protective effect and the surface-treating film formed by the above-described surface treatment method could improve the corrosion resistance of aluminum or an aluminum alloy.

EXAMPLE 3

An AC8A-T6 cast aluminum specimen having a diameter of 50 mm and a thickness of 5 mm was cleaned with an organic solvent and a degreasing agent, and then surface-treated by soaking it in a treating solution similar to treating solution 2 of the above Example 1 for 5 minutes.

With respect to the specimen having undergone the above-described surface treatment (i.e., the specimen of Example 3), a specimen (of AC8A-T6 material) having undergone a surface treatment with hard Alumite, and a specimen (of AC8A-T6 material) having undergone no surface treatment, their coefficients of friction under oil lubrication were measured by using SCM material as the opposite material. The results thus obtained are shown in Table 1.

TABLE 1

| | Coefficient of friction |
|---|---|
| Example 3 | 0.09 |
| Hard Alumite treatment | 0.13 |
| Untreated specimen | 0.12 |

It can be seen from the results shown in Table 1 that the above-described surface treatment caused a reduction in coefficient of friction.

EXAMPLE 4

An engine piston (made of AC8A-T6 material) was cleaned with an organic solvent and a degreasing agent, and then surface-treated by soaking it in a treating solution similar to treating solution 2 of the above Example 1 for 5 minutes. Thus, a film of $NH_4MgAlF_6$ was formed on the surface of the piston.

Both the piston having undergone the above-described surface treatment of the present invention (i.e., the piston of Example 4) and a piston not having undergone the above-described surface treatment (i.e., an untreated piston) were assembled into an engine, and this engine was actually operated at full load.

After operation, each piston was removed and inspected for surface conditions. The inspection items included adhesion of aluminum to the rings, scoring of the pin boss surface, and scoring of the skirt surface. The results thus obtained are shown in Table 2.

TABLE 2

| | Piston of Example 4 | Untreated piston |
|---|---|---|
| Adhesion of Al to rings | No | Yes |
| Scoring of pin boss surface | No | Yes |
| Scoring of skirt surface | No | Yes |

It can be seen from the results shown in Table 1 that the piston having undergone the surface treatment of the present invention showed improvements over the untreated piston with respect to all of the piston ring grooves, pin boss and skirt surface.

EXAMPLE 5

Six aluminum alloy materials having different silicon (Si) contents were cleaned with an organic solvent and a degreasing agent, and then surface-treated by soaking it in a treating solution similar to treating solution 2 of the above Example 1 for 5 minutes. As a result, aluminum (Al) in the aluminum alloy materials was dissolved in the treating solution. At the same time, the dissolved aluminum (Al) reacted with fluorine (F), magnesium (Mg) and ammonium ($NH_4$) in the treating solution to deposit a film on the aluminum alloy surface. During this process, the aforesaid film was formed while incorporating thereinto silicon particles which were hardly soluble in the treating solution, so that a film having silicon dispersed therein was obtained. Thus, various specimens coated with films having different silicon (Si) contents were obtained.

Figure 13:
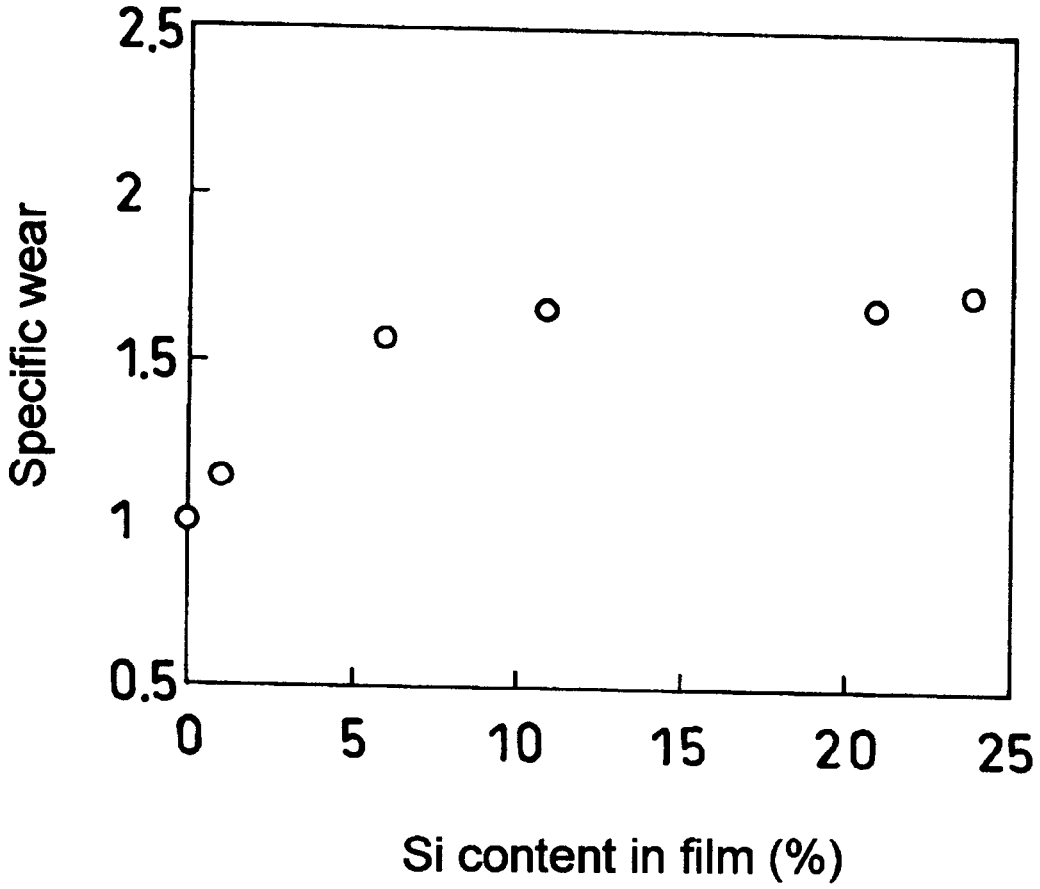
FIG. 13 is a graph showing the results of abrasion resistance tests carried out in Example 5.

The specimens thus obtained were subjected to pin-on-disc abrasion tests in which a cementation-hardened and tempered SCM420 pin was used as the opposite material. In these tests, the abrasion resistance of the films was evaluated in terms of wear volume. The results thus obtained are shown in FIG. 13.

It can be seen from the results that, when compared with the specimen containing no silicon (Si) in the film, even the specimen having a silicon content of about 1% showed an improvement in abrasion resistance, and that the specimens having a silicon content of 6% or greater were found to show a marked improvement in abrasion resistance.

EXAMPLE 6

This is an example in which an aluminum alloy was surface-treated with a treating solution (or aqueous solution) containing magnesium silicofluoride ($MgSiF_6 \cdot 6H_2O$) and ammonium borofluoride ($NH_4BF_4$).

0.67 part by weight of magnesium silicofluoride ($MgSiF_6 \cdot 6H_2O$) and 0.51 part by weight of ammonium borofluoride ($NH_4BF_4$) were dissolved in 100 parts by weight of water. This aqueous solution was heated to 90° C. and used as treating solution 3. An AC8A-T6 cast aluminum specimen having a diameter of 50 mm and a thickness of 5 mm was cleaned with an organic solvent and a degreasing agent, and then surface-treated by soaking it in the above treating solution for 5 minutes.

Figure 14:
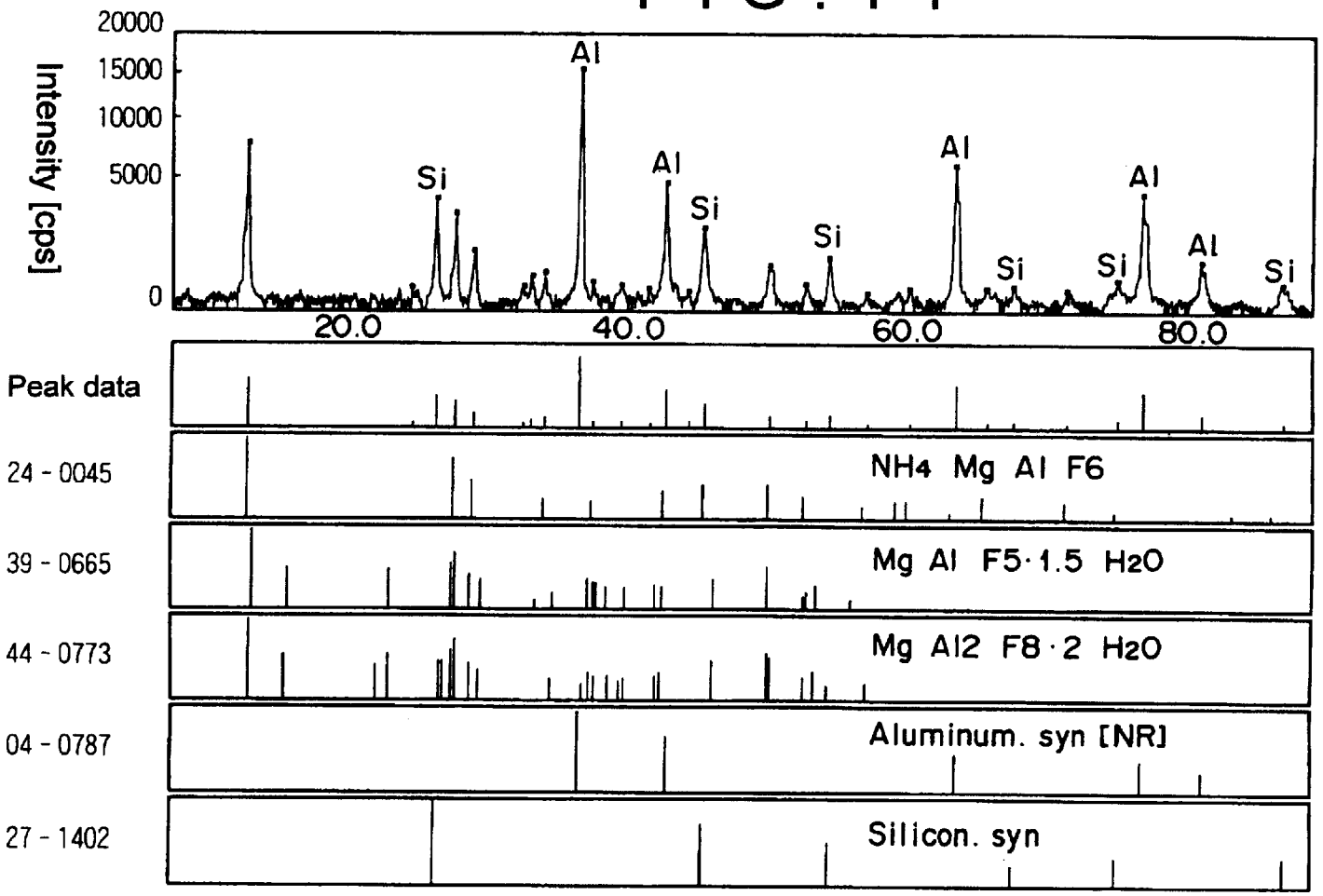
FIG. 14 is an X-ray diffraction diagram of a film formed with treating solution 3 of Example 6.

FIG. 14 shows the results of analysis of the formed film with an X-ray diffractometer, for the specimen having been surface-treated with the aforesaid treating solution 3 according to the present invention.

It can be seen from FIG. 14 that a film of $NH_4MgAlF_6$ was formed on the surface of the cast aluminum specimen as a result of the treatment with treating solution 3. However, this X-ray diffraction diagram includes both the X-ray diffraction spectrum of the formed film and the X-ray diffraction spectra of aluminum (Al) constituting the base metal (i.e., AC8A-T6 material) and silicon (Si) contained in the base metal.

EXAMPLE 7

This is an example in which an aluminum alloy was surface-treated with a treating solution (or aqueous solution) containing magnesium silicofluoride ($MgSiF_6 \cdot 6H_2O$) and ammonium chloride ($NH_4Cl$).

0.67 part by weight of magnesium silicofluoride ($MgSiF_6 \cdot 6H_2O$) and 0.26 part by weight of ammonium chloride ($NH_4Cl$) were dissolved in 100 parts by weight of water. This aqueous solution was heated to 90° C. and used as treating solution 4. An AC8A-T6 cast aluminum specimen having a diameter of 50 mm and a thickness of 5 mm was cleaned with an organic solvent and a degreasing agent, and then surface-treated by soaking it in the above treating solution for 5 minutes.

Figure 15:
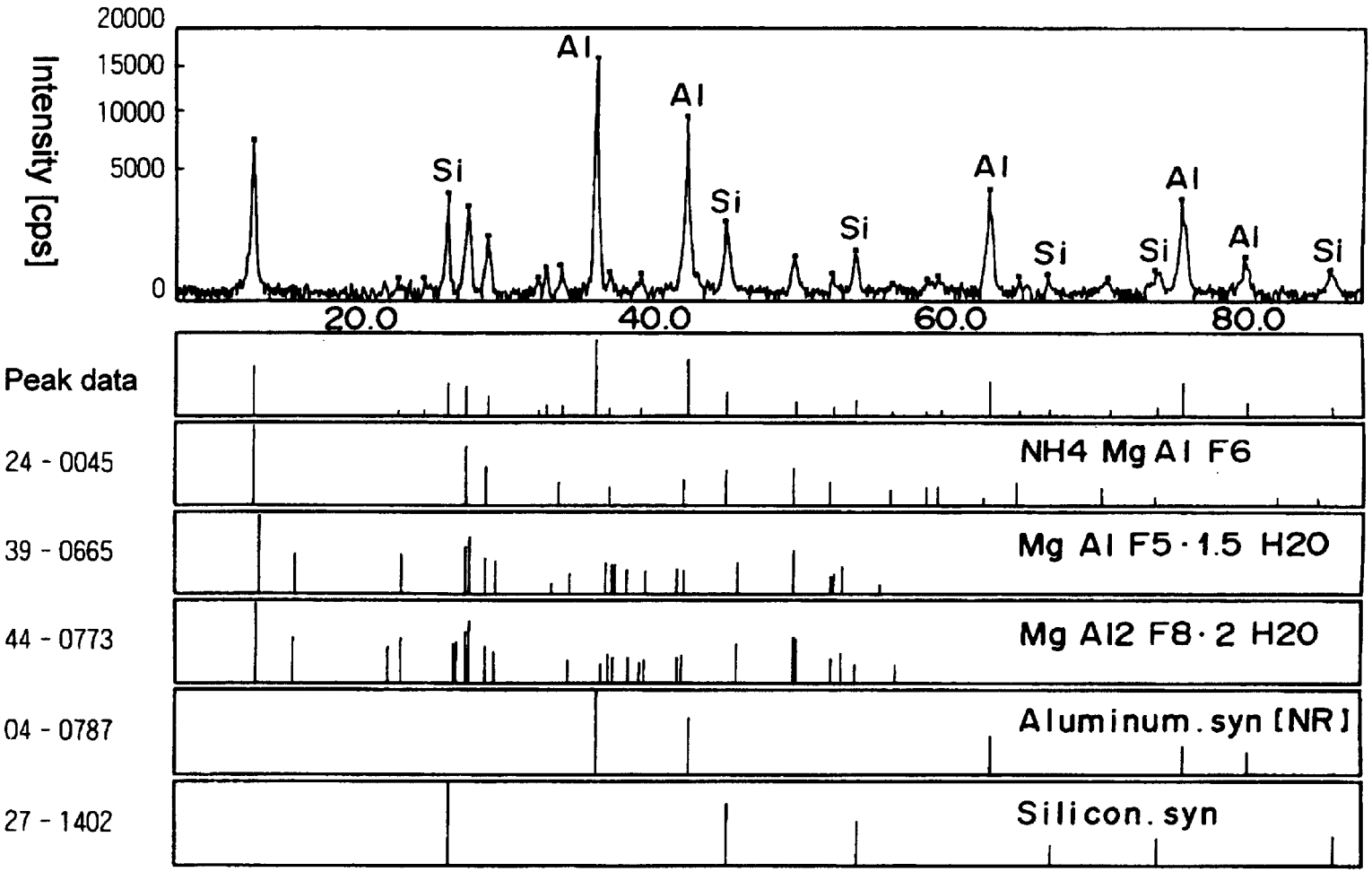
FIG. 15 is an X-ray diffraction diagram of a film formed with treating solution 4 of Example 7.

FIG. 15 shows the results of analysis of the formed film with an X-ray diffractometer, for the specimen having been surface-treated with the aforesaid treating solution 4 according to the present invention.

It can be seen from FIG. 15 that a film of $NH_4MgAlF_6$ was formed on the surface of the cast aluminum specimen as a result of the treatment with treating solution 4. However, this X-ray diffraction diagram includes both the X-ray diffraction spectrum of the formed film and the X-ray diffraction spectra of aluminum (Al) constituting the base metal (i.e., AC8A-T6 material) and silicon (Si) contained in the base metal.

EXAMPLE 8

This is an example in which an aluminum alloy was surface-treated with a treating solution (or aqueous solution) containing magnesium silicofluoride ($MgSiF_6 \cdot 6H_2O$) and an aqueous solution of ammonia.

0.67 part by weight of magnesium silicofluoride ($MgSiF_6 \cdot 6H_2O$) and 2 ml of aqueous ammonia (25% aqueous solution) were dissolved in 100 parts by weight of water. This aqueous solution was heated to 90° C. and used as treating solution 5. An AC8A-T6 cast aluminum specimen having a diameter of 50 mm and a thickness of 5 mm was cleaned with an organic solvent and a degreasing agent, and then surface-treated by soaking it in the above treating solution for 5 minutes.

Figure 16:
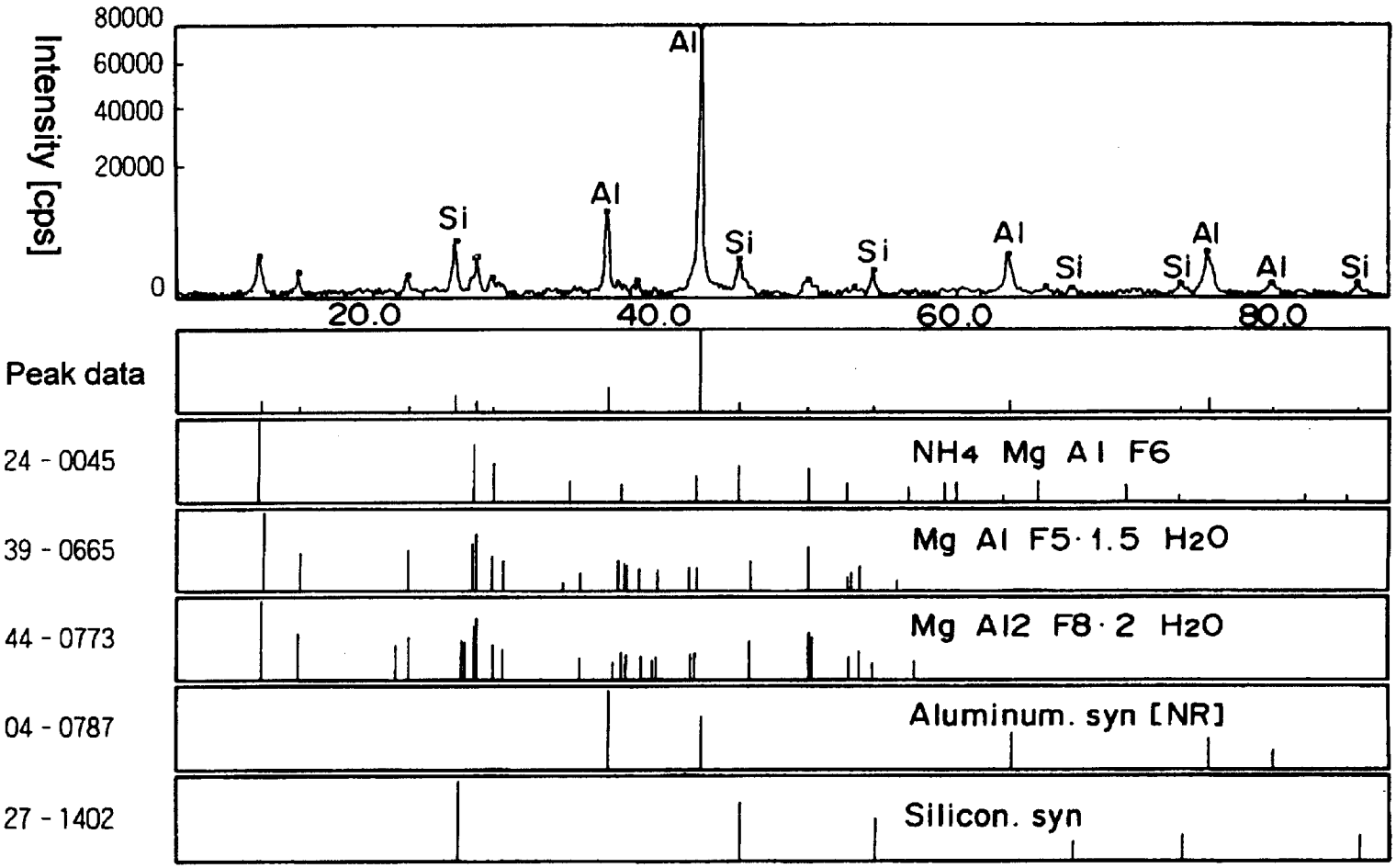
FIG. 16 is an X-ray diffraction diagram of a film formed with treating solution 5 of Example 8.

FIG. 16 shows the results of analysis of the formed film with an X-ray diffractometer, for the specimen having been surface-treated with the aforesaid treating solution 5 according to the present invention.

It can be seen from FIG. 16 that a film consisting of a mixture of $NH_4MgAlF_6$ and $MgAlF_5 \cdot 1.5H_2O$ or a mixture of $NH_4MgAlF_6$ and $MgAl_2F_8 \cdot 2H_2O$ was formed on the surface of the cast aluminum specimen as a result of the treatment with treating solution 5. However, this X-ray diffraction diagram includes both the X-ray diffraction spectrum of the formed film and the X-ray diffraction spectra of aluminum (Al) constituting the base metal (i.e., AC8A-T6 material) and silicon (si) contained in the base metal.

What is claimed is:

1. A sliding member made of a base metal comprising aluminum or an aluminum alloy, wherein the whole surface of the sliding member or the sliding surface thereof is coated with a film which comprises a mixture of $NH_4MgAlF_6$ and $MgAlF_5 \cdot 1.5H_2O$ or a mixture of $NH_4MgAlF_6$ and $MgAl_2F_8 \cdot 2H_2O$, has a cubic crystal structure, and shows no crystalline orientation.

2. A surface-treating film for aluminum alloys wherein the surface-treating film is a film formed on a surface of aluminum or an aluminum alloy said film comprising a mixture of $NH_4MgAlF_6$ and $MgAlF_5 \cdot 1.5H_2O$ or a mixture of $NH_4MgAlF_6$ and $MgAl_2F_8 \cdot 2H_2O$, and having silicon particles dispersed therein, the content of silicon particles dispersed in the film is in the range of 1 to 24% by weight, and the content of silicon in the aluminum alloy is in the range of 4 to 24% by weight.

3. A sliding member made of a base metal comprising aluminum or an aluminum alloy, wherein the whole surface of the sliding member or the sliding surface thereof is coated with a film which consists of a mixture of $NH_4MgAlF_6$ and $MgAlF_5 \cdot 1.5\ H_2O$ or a mixture of $NH_4MgAlF_6$ and $MgAl_2F_8 \cdot 2H_2O$.

* * * * *